US010428487B2

(12) United States Patent
Cassidy et al.

(10) Patent No.: US 10,428,487 B2
(45) Date of Patent: Oct. 1, 2019

(54) LINER

(71) Applicant: NORTHSTONE (NI) LIMITED, Belfast (GB)

(72) Inventors: Lee Cassidy, Belfast (GB); Graeme Pringle, Belfast (GB)

(73) Assignee: NORTHSTONE (NI) LIMITED, Dunmurry, Belfast (GB)

( * ) Notice: Subject to any disclaimer, the term of this patent is extended or adjusted under 35 U.S.C. 154(b) by 0 days.

(21) Appl. No.: 15/313,438

(22) PCT Filed: May 21, 2015

(86) PCT No.: PCT/GB2015/051507
§ 371 (c)(1),
(2) Date: Nov. 22, 2016

(87) PCT Pub. No.: WO2015/177564
PCT Pub. Date: Nov. 26, 2015

(65) Prior Publication Data

US 2017/0152642 A1 Jun. 1, 2017

(30) Foreign Application Priority Data

May 22, 2014 (GB) ..... 1409133.4

(51) Int. Cl.
*E02D 29/12* (2006.01)
*E02D 29/14* (2006.01)

(52) U.S. Cl.
CPC ..... *E02D 29/125* (2013.01); *E02D 29/12* (2013.01); *E02D 29/124* (2013.01); *E02D 29/1463* (2013.01); *E02D 2300/007* (2013.01)

(58) Field of Classification Search
CPC ..... E02D 29/125; E02D 29/12; E02D 29/121; E02D 29/14; E02D 2300/0006; E02D 2300/0007
See application file for complete search history.

(56) References Cited

U.S. PATENT DOCUMENTS 6,195,944 B1 * 3/2001 Goldthorpe ..... E02D 29/12 52/19
2005/0238437 A1 * 10/2005 Kamiyama ..... F16L 55/16455 405/184.1

FOREIGN PATENT DOCUMENTS

EP 1245738 A1 10/2002
EP 1916342 A1 4/2008
GB 2342676 * 4/2000

* cited by examiner

*Primary Examiner* — Carib A Oquendo
(74) *Attorney, Agent, or Firm* — Schwabe Williamson & Wyatt, P.C.

(57) ABSTRACT

A liner for a manhole cover is made up of stackable sections. Each stackable section is formed of a plurality (e.g. 4) pieces. Each piece comprises a first arm and a second arm which are substantially perpendicular to one another, the first arm being longer than the second arm, and both arms comprising connection means to allow the pieces to be connected together. The respective dimensions of the first arm and the second arm are chosen such that, when the piece is incorporated into a stackable section comprising three other corresponding pieces that are connected to each other in a sequence of a second arm of one piece connected to the first arm of an adjacent piece to form a quadrilateral stackable section, a further corresponding piece can fit within the stackable section along an axis substantially parallel to the longitudinal axis of the first arm. Further corresponding pieces can thus be arranged within a complete stackable section to maximize the number of pieces that can be transported in a given space.

21 Claims, 8 Drawing Sheets

7
l
17

7
13
11
25
23
21

7
27

LINER

CROSS REFERENCE TO RELATED APPLICATIONS

The present application is a national phase entry under 35 U.S.C. § 371 of International Application No. PCT/GB2015/051507, filed May 21, 2015, entitled "A LINER," which designated, among the various States, the United States of America, and which claims priority to GB1409133.4 filed May 22, 2014, both of which are hereby incorporated by reference in their entirety.

TECHNICAL FIELD OF THE INVENTION

The present invention relates to a liner. The liner is particularly, but not exclusively intended for use in manhole chambers and the like.

BACKGROUND TO THE INVENTION

Liners are used to line a manhole chamber to provide a barrier between the space defined by the chamber and the surrounding earth. Liners of this general type are known. One such liner is disclosed in EP0787861 which describes a liner comprising a number of stackable sections moulded from synthetic plastics materials. Each section comprises inner and outer skins joined together by two series of webs extending between and at right angles to the skins in the stacking direction. The sections are adapted to be stacked upon one another to permit the assembly of a corrosion resistant load bearing, rigid and deformation resisting structure.

A problem with the liner disclosed in EP0787861 is that it is difficult to manufacture and assemble. A proposed improved chamber liner is described in EP2622142 which discloses a liner comprising a number of stackable sections which are each comprised of separate connected pieces. The pieces are manufactured using a pultrusion technique. Whilst the liner can be broken down into smaller pieces for transportation purposes, the liner is difficult and costly to manufacture.

It is therefore an object of the present invention to provide an improved liner that is easy to manufacture, transport and assemble.

SUMMARY OF THE INVENTION

According to a first aspect of the present invention, there is provided a piece for a stackable section used in a liner for a manhole chamber, the piece comprising a first arm and a second arm which are substantially perpendicular to one another, the first arm being longer than the second arm, wherein the first and second arms each comprise connection means to enable each arm to be connected to an adjacent arm of a corresponding piece and wherein the respective dimensions of the first arm and the second arm are chosen such that, when the piece is incorporated into a stackable section comprising three other corresponding pieces that are connected to each other in a sequence of a first arm of one piece connected to the second arm of an adjacent piece to form a quadrilateral stackable section, a further corresponding piece can fit within the stackable section along an axis substantially parallel to the longitudinal axis of the first arm.

Advantageously, a number of pieces can be nested side by side within and across the width of a stackable section formed from four pieces. This maximises the number of pieces that can be transported in a given space and therefore minimises transportation costs. Further, a stackable section can be easily assembled from pieces according to the invention.

The corresponding pieces may each comprise a first arm and a second arm which are substantially perpendicular to one another, the first arm being longer than the second arm, wherein the first and second arms each comprise connection means to enable each arm to be connected to an adjacent arm of a corresponding piece and wherein the respective dimensions of the first arm and the second arm are chosen such that, when the piece is incorporated into a stackable section comprising three other corresponding pieces that are connected to each other in a sequence of a first arm of one piece connected to the second arm of an adjacent piece to form a quadrilateral stackable section, a further corresponding piece can fit within the stackable section along an axis substantially parallel to the longitudinal axis of the first arm.

The corresponding pieces may be identical to the piece of the first aspect of the invention.

The first arm and the second arm may each comprise an inner skin and an outer skin and the second arm may extend beyond the inner skin of the first arm by a distance which is greater than a width across the short arm from its inner skin to its outer skin.

The first arm and second arm may each comprise a free end. A length of the short arm as measured from the inner skin of the long arm to the free end of the short arm along the longitudinal axis of the short arm combined with a length of the long arm as measured from the inner skin of the short arm to the free end of the long arm along the longitudinal axis of the long arm may be greater than the length of the piece as measured from the free end of the long arm to the outer skin of the short arm along the longitudinal axis of the long arm.

The inner and outer skins may be substantially flat.

According to a second aspect of the present invention, there is provided a plurality of pieces according to the first aspect, wherein the length of each short arm of each piece is substantially the same and the length of the long arm of at least two pieces is different.

According to a third aspect of the present invention, there is provided a plurality of pieces according to the first aspect comprising at least two pieces whose respective long arms are substantially the same length, wherein one of the two pieces is substantially symmetrical with the other of the two pieces.

The symmetry may be about the longitudinal axis of the long arm, i.e. the two pieces may be mirror images of each other, in order to permit the assembly of a stackable section wherein joins between the plurality of corresponding pieces of one section are offset relative to the joins between the plurality of corresponding pieces of a section above and/or below.

According to a fourth aspect of the present invention, there is provided a stackable section which may be stacked with other sections to form a liner for a manhole chamber, the stackable section comprising a pair of pieces according to the first aspect.

The stackable section may comprise four pieces according to the first aspect.

The short arm of each piece may be substantially the same length as the short arm of each other piece.

The long arm of each piece may be substantially the same length as the long arm of each other piece.

Where the stackable section comprises four pieces according to the first aspect, the long arms of two pieces may be a first length and the long arms of the other two pieces may be a second, different, length.

According to a fifth aspect of the present invention, there is provided a liner for a manhole chamber comprising a plurality of pieces according to the third or fourth aspects.

The liner may comprise a plurality of stackable sections, each stackable section formed from a plurality of pieces according to the first aspect of the invention joined together and one stackable section is stacked on top of another, wherein the joins of one section are offset relative to the other section on which it is stacked.

DETAILED DESCRIPTION OF THE INVENTION

In order that the invention may be more clearly understood an embodiment thereof will now be described, by way of example only, with reference to the accompanying drawings, of which:

FIG. 1 is a perspective view of part of a liner for a chamber comprising pieces according to the invention;

FIG. 2*a* is a plan view of a piece incorporated into the liner shown in FIG. 1;

FIG. 2*b* is a plan view of another piece incorporated into the liner shown in FIG. 1;

FIG. 2*c* is an underside view of the piece shown in FIG. 2*b;*

Figure 1:
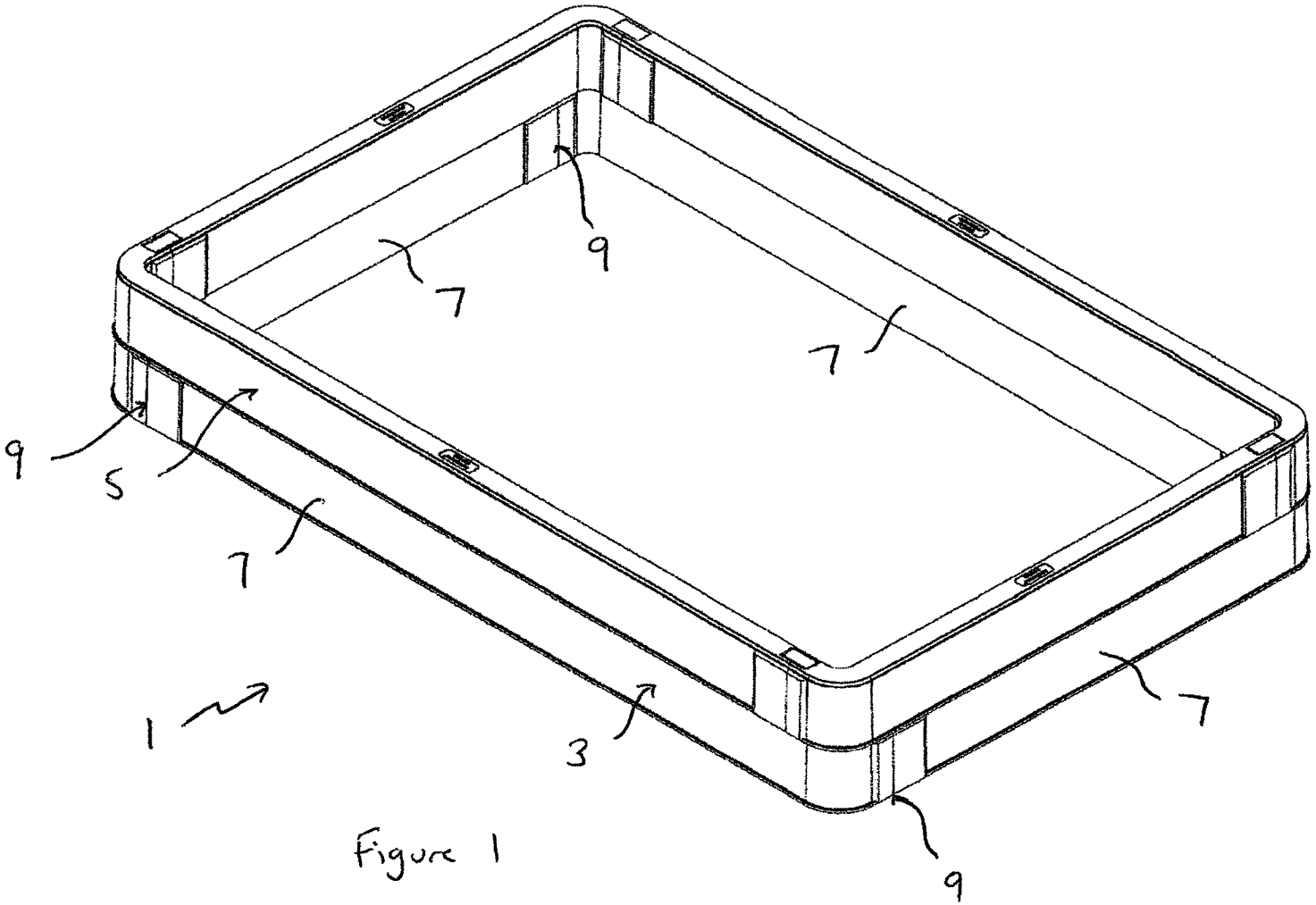
Figures 2A, 2B, 2C:
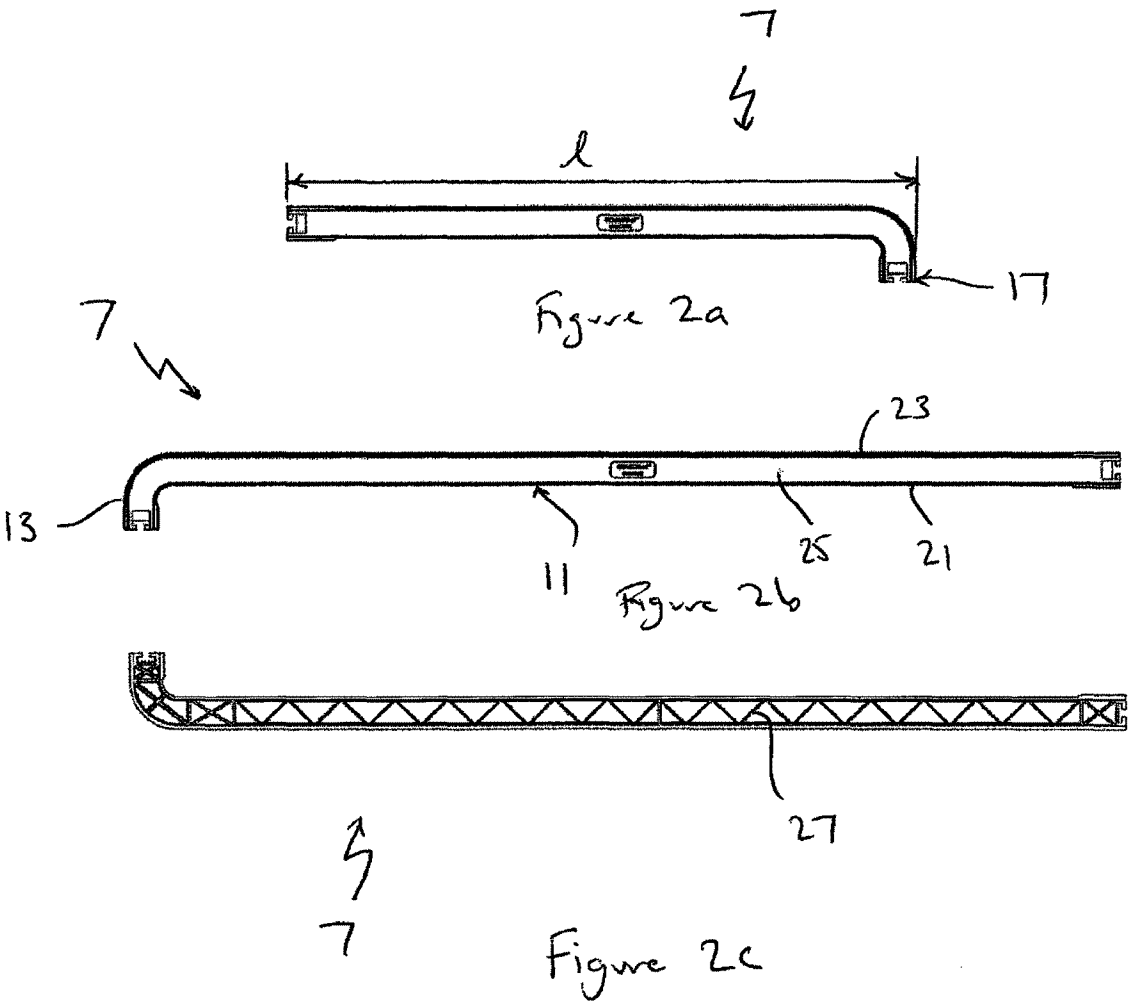
Figure 3:
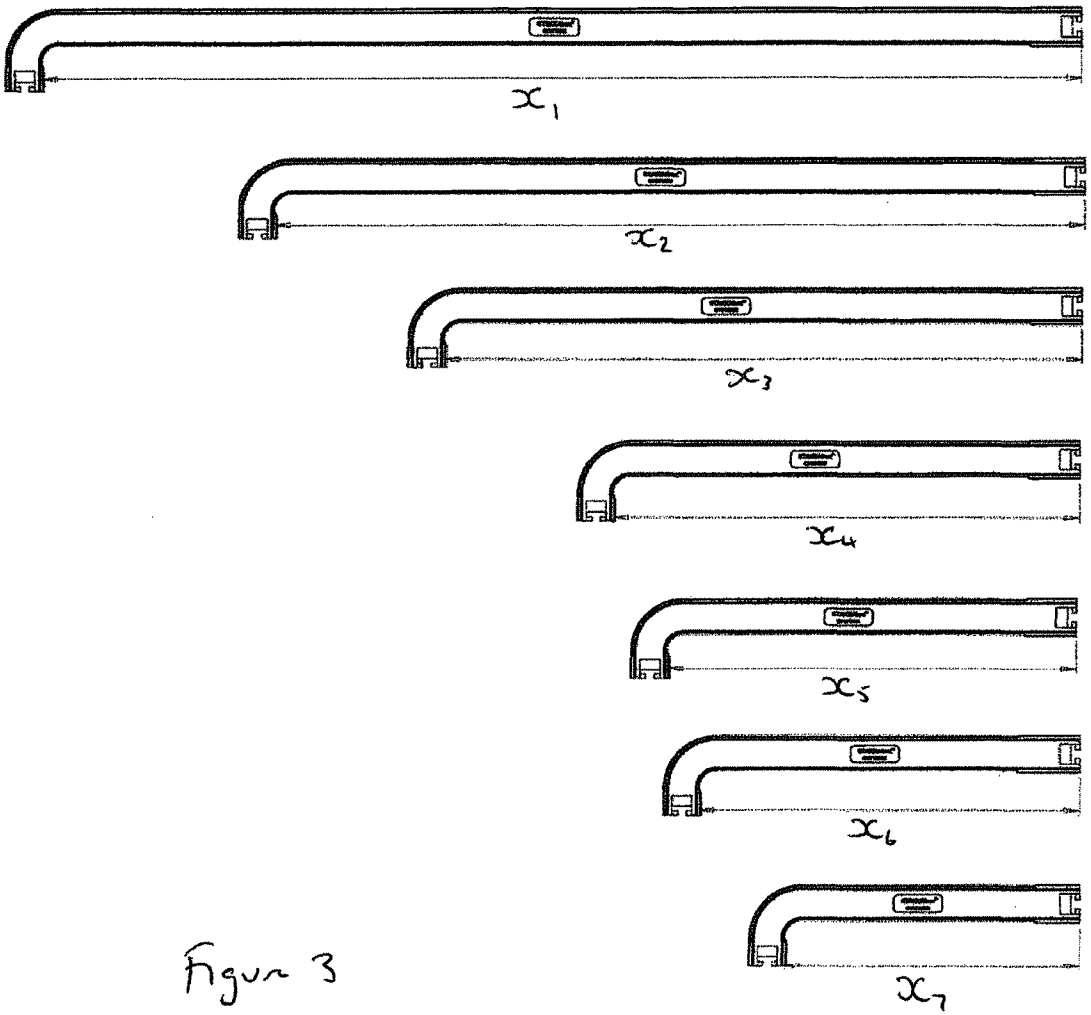
FIG. 3 is a plan view of a plurality of different pieces according to the invention.
Figure 4:
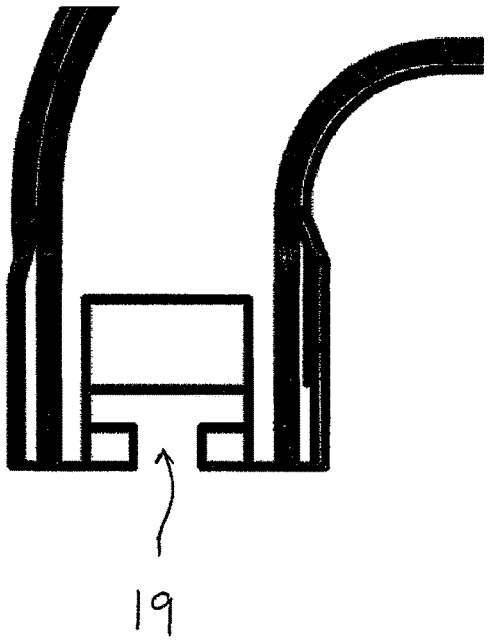
FIG. 4 is an enlarged cross section view of an end of the piece shown in FIG. 2*c;*
Figure 5:
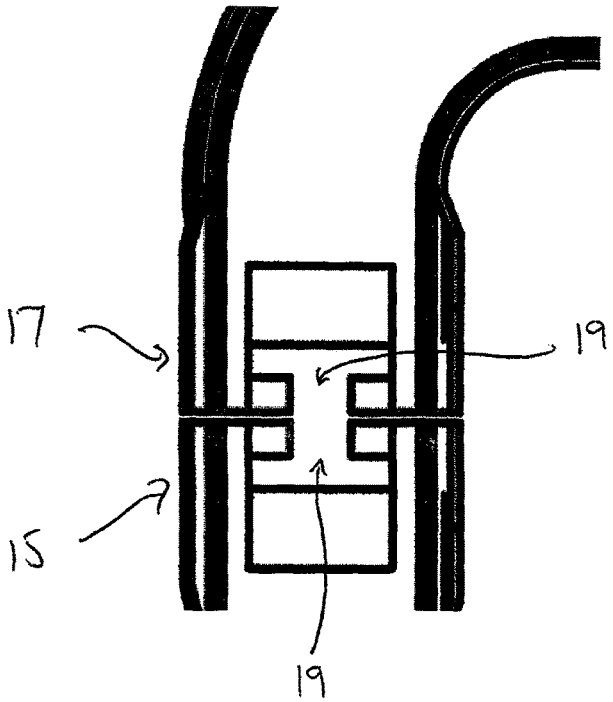
FIG. 5 is an enlarged cross section view of the end of the piece shown in FIG. 4 arranged adjacent an end of another piece according to the invention.

In the following the terms upward, upper, lower, inner, outer and like terms are used for convenience and refer to the stackable section and liner as shown oriented in the drawings, the orientation in which it is intended to be used, and should not be taken as otherwise limiting.

With reference to the drawings there is shown a liner 1 for a manhole chamber comprising two stackable sections 3, 5 stacked one on top of the other. Each stackable section 3, 5 comprises four interconnected pieces 7, each piece being connected to an adjacent piece at their respective ends to form a substantially quadrilateral section. The two stackable sections 3, 5 are stacked such that the points of connection or joins 9 between the adjacent pieces 7 of the lower section 3 are offset relative to the joins of the upper section so that the upper and lower joins do not align. It is intended that this alternating joint arrangement be repeated for subsequent sections that may be stacked on top of the two shown in FIG. 1 when forming a deeper liner 1.

Each piece 7 is made from compression moulded glass fibre polyester resin material and comprises a long arm 11 and a short arm 13 which are arranged to be substantially perpendicular to one another. The two arms 11, 13 extend from a common point and each terminates at a free end 15, 17. The free end 15, 17 of each arm 11, 13 comprises a substantially vertical face into which is formed a T-shaped recess 19 which extends into the body of the arms 11, 13 from the respective faces. The pieces 7 are arranged such that when one face of one free end 15 of a piece 7 is arranged adjacent a face of a free end 17 of a corresponding piece 7 such that the two free ends interface, a H-shape is formed by the combined T-shaped recesses 19. A peg 20 having a profile which substantially matches the H-shape formed by the two recesses is provided which may be inserted into the H-shaped gap to hold the two pieces 7 together.

The pieces 7 each comprise substantially flat, smooth inner 21 and outer skins 23 joined together by an upper web 25 that extends between and substantially at right angles to the inner and outer skins 21, 23 at their upper edges. An internal web 27 extends between the inner and outer skins along the arms of the piece 7 in a zigzag formation to improve sidewall loading and strengthen the piece 7.

Figure 6:
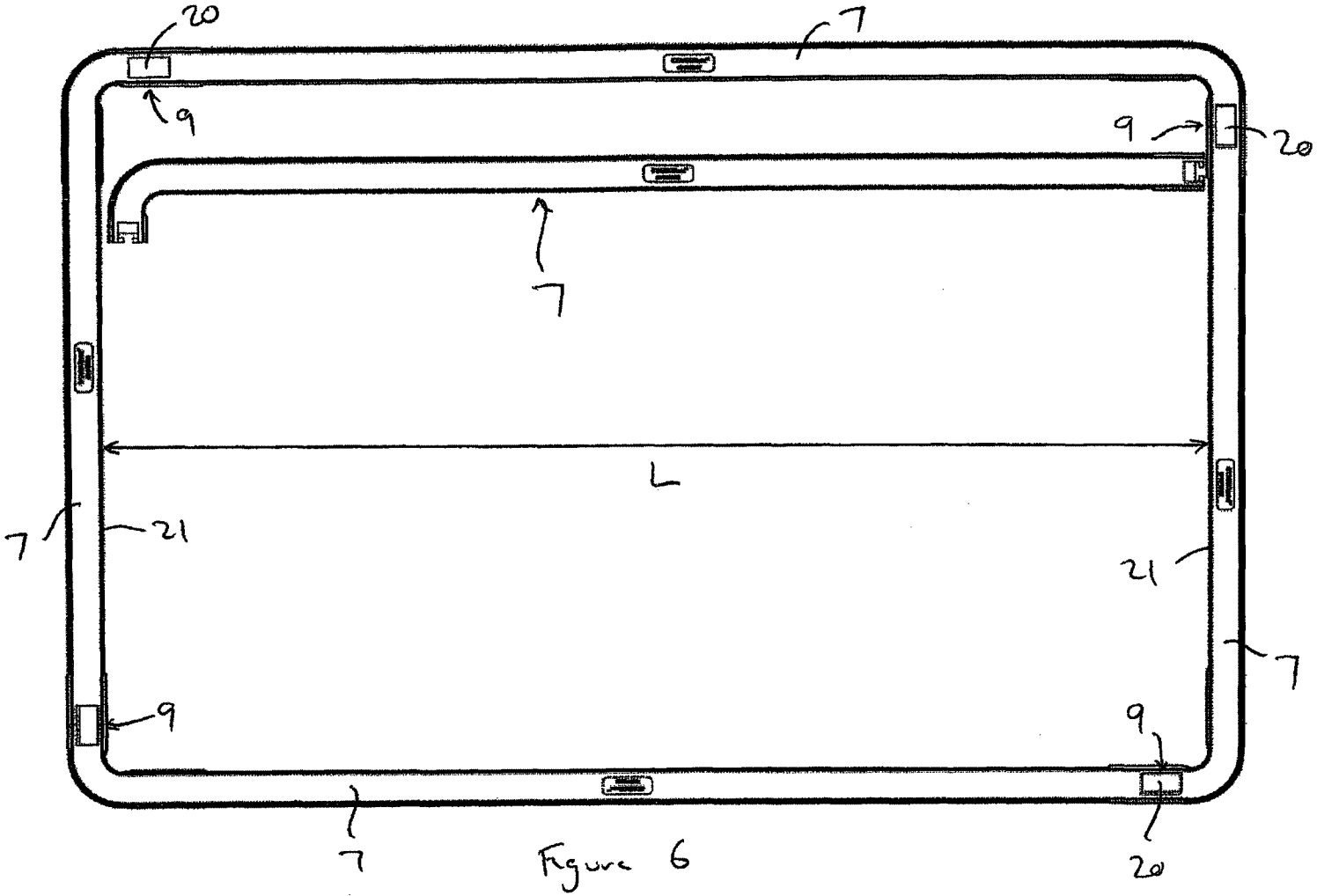
FIG. 6 is a plan view of a stackable section comprising two pieces shown in FIG. 2*a* and two pieces shown in FIG. 2*b* with a further piece as shown in FIG. 2*a* nested within the section.
Figure 7:
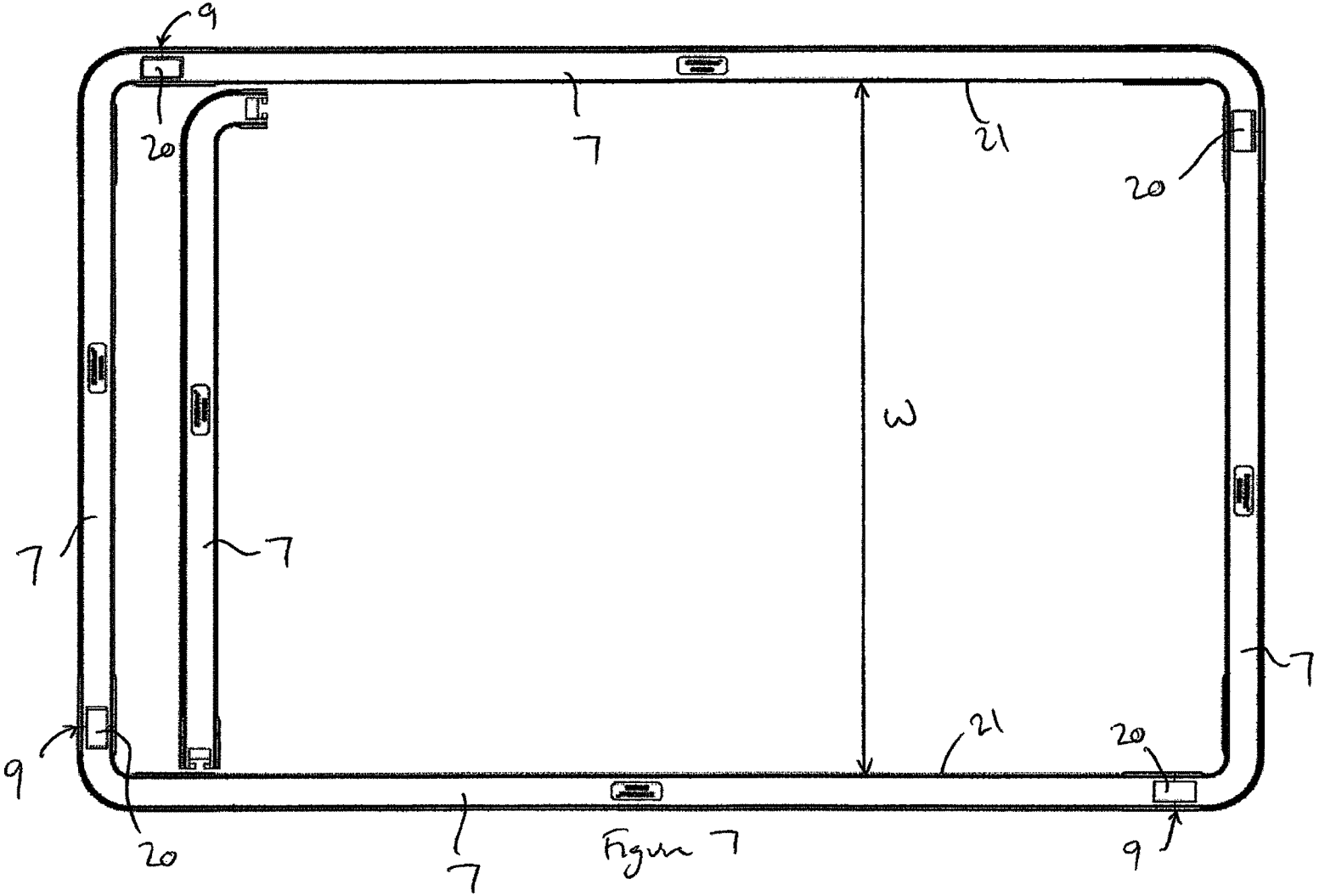
FIG. 7 is a plan view of the stackable section shown in FIG. 6 with a further piece as shown in FIG. 2*b* nested within the section.
Figure 8:
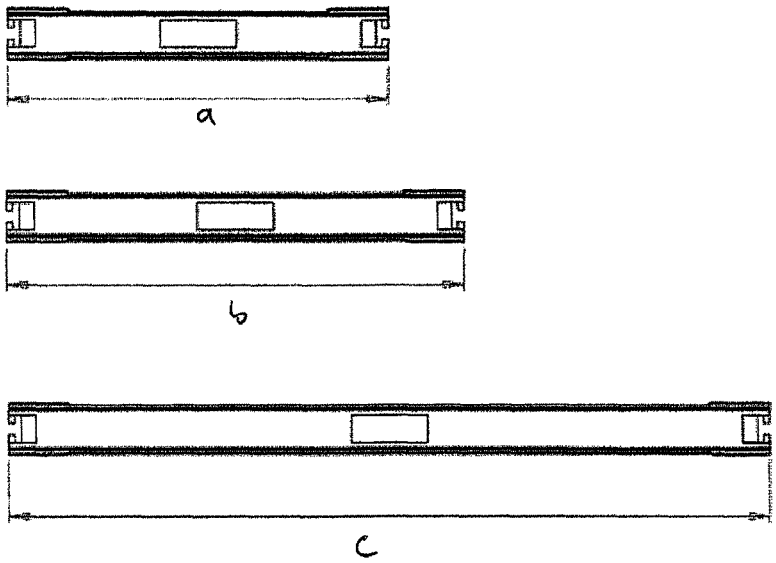
FIG. 8 is a plan view of a plurality of straight pieces which may be connected to the pieces shown in FIGS. 2*a* and 2*b*.

The short arm 13 of each piece 7 extends beyond a point of the inner skin 21 of the long arm to the short arm's free end 17 a distance which is greater than a width of the short arm 13. The length of the short arm 13 as measured along the longitudinal axis of the short arm 13 from a point of the inner skin 21 of the long arm 11 to the free end 17 of the short arm 13 combined with a length of the long arm 11 as measured along the longitudinal axis of the long arm 11 from a point of the inner skin 21 of the short arm 13 to the free end 15 of the long arm 11 is greater than the length 1 of the piece 7 as measured along the longitudinal axis of the long arm 11. Thus, when a stackable section is assembled from four corresponding pieces 7, the internal width W or length L of the stackable section from a point of the inner skin 21 of one of the pieces 7 to a point of the inner skin 21 of the piece 7 directly opposite is greater than the length 1 of the piece 7 itself. Thus, a further corner piece 7 may be nested within the assembled section along the longitudinal axis of a long arm of a corner piece 7 as shown in FIGS. 6 and 7.

A plurality of different pieces 7 may be moulded having the above described features. The pieces 7 may differ as to the length of one of the arms $x_1$, $x_2$, $x_3$, $x_4$, $x_5$, $x_6$, $x_7$, $x_n$ and remain constant as to the length of the other arm. In this embodiment, a first range comprising seven different pieces 7 are provided whose long arms 11 are approximately 1820 mm, 1420 mm, 1120 mm, 820 mm, 720 mm, 670 mm and 520 mm in length, respectively, as measured along the longitudinal axis of the long arm 11 from the inner skin 21 of the short arm 13 to the free end 15 of the long arm 11. The short arm 13 of each piece 7 is approximately 80 mm in length as measured along the longitudinal axis of the short arm 13 from the inner skin 21 of the long arm 11 to the free end 17 of the short arm 13. Thus, a number of stackable sections 3, 5 can be assembled with differing dimensions by selecting the appropriate pieces 7. If it is desired to assemble a square section, four pieces 7 having the same length long arm 11 are chosen and connected together. If it is desired to assemble a rectangular section, a pair of pieces 7 whose long arms are the same length is connected to a pair of a pieces 7 whose long arms are the same as one another but different from the first pair.

A second corresponding range of pieces 7 is also envisaged which is symmetrical with the above described first range about the longitudinal axis of the long arm 11. The symmetrical pieces permit the assembly of a stackable section whose joins 9 are offset relative to the joins 9 of a stackable section comprising pieces 7 from the first range. As described above, this permits a liner 1 to be constructed that comprises alternating stackable sections formed from the first range and second range, respectively, so that the joins 9 of each section do not align and extend upwardly along the entire height of the liner thereby creating a weak point.

Different length straight pieces 29 are also provided which have corresponding T-shaped recesses formed in their free ends to enable them to be attached to the free ends of the corner pieces 7. The straight pieces 29 permit further variations of stackable sections to be assembled as desired without having to manufacture even longer corner pieces 7.

The above embodiment is described by way of example only. Many variations are possible without departing from the scope of the invention as defined in the appended claims.

The invention claimed is:

1. A stackable section used in a liner for a manhole chamber, comprising:

at least four single pieces, each single piece having a straight portion and a curved portion; and a first arm and a second arm which are substantially perpendicular to one another, the first arm of each single piece being longer than the second arm of each single piece, wherein the first and second arms each comprise a connector to enable each arm to be connected to an adjacent piece, wherein a length of the second arm of each single piece is substantially the same, and a length of the first arm of a first piece of the at least four single pieces is different from a length of the first arm of a second piece of the at least four single pieces, wherein the at least four single pieces assemble to form an enclosed stackable section, and wherein respective dimensions of the first arm and the second arm of each single piece are chosen such that, when each piece is incorporated into the stackable section, a further corresponding piece can fit within the stackable section along an axis substantially parallel to a longitudinal axis of the first arm.

2. The stackable section as claimed in claim 1, wherein the first arm and the second arm each comprise an inner skin and an outer skin and wherein the second arm extends beyond a region of the inner skin of the first arm by a distance which is greater than a width across the second arm from its inner skin to its outer skin.

3. The stackable section as claimed in claim 1, wherein the first arm and second arm each comprise a free end.

4. The stackable section as claimed in claim 3, wherein a length of the second arm as measured along a longitudinal axis of the second arm from a point of the inner skin of the first arm to the free end of the second arm combined with a length of the first arm as measured along the longitudinal axis of the first arm from a point of the inner skin of the second arm to the free end of the first arm is greater than a length of each single piece as measured along the longitudinal axis of the first arm.

5. The stackable section as claimed in claim 1, comprising at least two pieces whose respective first arms are substantially the same length, wherein one of the two pieces is substantially symmetrical with the other of the two pieces.

6. The stackable section as claimed in claim 5, wherein the symmetry is about the longitudinal axis of the first arm, such that the two pieces are mirror images of each other, in order to permit the assembly of the stackable section wherein joins between the plurality of corresponding single pieces are offset relative to the joins between a plurality of corresponding single pieces of an adjacent stackable section stacked above and/or below the stackable section.

7. The stackable section according to claim 1, wherein the first arms of two single pieces are a first length and the first arms of the two other single pieces are a second, different, length.

8. A liner for a manhole chamber comprising the stackable section according to claim 6.

9. The liner according to claim 8, comprising a plurality of stackable sections, each stackable section formed according to claim 1 and joined together, and wherein one stackable section is stacked on top of another, wherein the joins of one section are offset relative to the other section on which it is stacked.

10. A plurality of single pieces, each for forming part of a respective stackable section of a chamber, each section comprised of at least four single pieces, each of the plurality of single pieces having a first arm and a second arm disposed substantially perpendicular to, and having a different length from, the first arm, wherein one of the plurality of single pieces is of a first configuration, and another of the single pieces is of a second configuration that is a mirror image of the first configuration.

11. The plurality of single pieces of claim 10, wherein the first arm of each single piece is substantially the same length as the first arm of each other single piece.

12. The plurality of single pieces of claim 11, wherein for each section the second arms of two single pieces are a first length and the second arms of the two other single pieces are a second, different, length.

13. The plurality of single pieces of claim 12, wherein each single piece further comprises substantially flat inner and outer skins.

14. A liner of a chamber comprised of at least a first section and a second section stacked atop the first section, each section comprised of at least four single pieces, wherein each single piece has a first arm and a second arm disposed substantially perpendicular to the first arm;

wherein a length of the second arm of each single piece is substantially the same, and a length of the first arm of a first piece of the at least four single pieces is different from a length of the first arm of a second piece of the at least four single pieces; and wherein at least one of the at least four single pieces of the first section has a different configuration from at least one of the at least four single pieces of the second section, such that the joins of the first section are offset relative to the joins of the second section.

15. The liner of claim 14, wherein the second arm of each single piece is substantially the same length as the second arm of each other single piece.

16. The liner of claim 14, wherein the first and second arms of each single piece in the first section are of substantially the same length.

17. The liner of claim 16, wherein the first and second arms of each single piece in the second section are of substantially the same length, the length being different from the length of the first and second arms of each single piece in the first section.

18. The liner of claim 14, wherein the first arm of each single piece is of a different length than the second arm of each single piece.

19. The liner of claim 18, wherein at least two of the single pieces of the first section are of a first configuration, and at least two of the single pieces of the second section are of a second configuration that is a mirror image of the first configuration.

20. The liner of claim 14 wherein for each of the first and second sections the first arms of two single pieces are a first length and the first arms of the two other single pieces are a second, different, length.

21. A single piece for a stackable section used in a liner for a manhole chamber, the single piece comprising:

a first arm and a second arm which are substantially perpendicular to one another, the first arm being longer than the second arm, wherein the first and second arms each comprise connection means to enable each arm to be connected to an adjacent arm of a corresponding single piece;

wherein the first arm and the second arm each comprise an inner skin and an outer skin and characterized in that the second arm extends beyond a region of the inner skin of the first arm by a distance which is greater than a width across the short arm from its inner skin to its outer skin; and the respective dimensions of the first arm and the second arm are chosen such that, when the single piece is incorporated into a stackable section comprising three other corresponding single pieces that are connected to each other in a sequence of a second arm of one single piece connected to the first arm of an adjacent single piece to form a quadrilateral stackable section, a further corresponding piece can fit within the stackable section along an axis substantially parallel to the longitudinal axis of the first arm.

* * * * *